US007249699B2

(12) United States Patent
Hill et al.

(10) Patent No.: US 7,249,699 B2
(45) Date of Patent: Jul. 31, 2007

(54) COLLAPSIBLE GARMENT HANGER WITH QUICK-RELEASE LEVER

(75) Inventors: Scott Allen Hill, Phoenix, AZ (US); Zachary R. Cresap, Gilbert, AZ (US); Jennifer Rebekah Hartmark-Hill, Phoenix, AZ (US)

(73) Assignee: Zadee Industries, LLC, Gilbert, AZ (US)

( * ) Notice: Subject to any disclaimer, the term of this patent is extended or adjusted under 35 U.S.C. 154(b) by 21 days.

(21) Appl. No.: 11/124,338

(22) Filed: May 6, 2005

(65) Prior Publication Data

US 2006/0097017 A1 May 11, 2006

Related U.S. Application Data

(63) Continuation-in-part of application No. 10/985,556, filed on Nov. 10, 2004.

(51) Int. Cl.
*A41D 27/22* (2006.01)

(52) U.S. Cl. ..... 223/94; 223/85; 223/89; 223/92

(58) Field of Classification Search ..... 223/85, 223/92, 94, 98, 89, 90; D6/318, 328; 211/85.3, 211/113
See application file for complete search history.

(56) References Cited

U.S. PATENT DOCUMENTS 2,409,269 A * 10/1946 Gersohn ..... 223/94
2,440,637 A * 4/1948 Lowe ..... 223/94
2,500,729 A * 3/1950 Winnemore ..... 223/85
2,872,090 A * 2/1959 Goodman ..... 223/94
D189,897 S * 3/1961 Zifferblatt ..... D6/318
3,082,921 A * 3/1963 Sadowsky ..... 223/94
3,151,788 A * 10/1964 Wingate ..... 223/88
3,802,610 A * 4/1974 Love et al. ..... 223/94
4,988,021 A * 1/1991 Adams et al. ..... 223/94
5,007,562 A * 4/1991 Brink et al. ..... 223/89
5,613,627 A * 3/1997 Marks ..... 223/85
5,690,257 A * 11/1997 Ward ..... 223/94
6,427,882 B1 * 8/2002 Harvey ..... 223/85
6,540,121 B1 * 4/2003 Harvey ..... 223/85
D518,653 S * 4/2006 de Groot ..... D6/318

* cited by examiner

*Primary Examiner*—Gary L. Welch
*Assistant Examiner*—Nathan E Durham
(74) *Attorney, Agent, or Firm*—The Hill Law Firm, PLC; Scott A. Hill

(57) ABSTRACT

The present invention is an apparel apparatus that is especially useful for hanging narrow or small necked shirts and sweaters. It is a collapsible garment hanger, or clothing hanger, that has moving parts. There are two hanger arms that rotate about pins on a hanger body, and there is a fulcrum about which a quick-release lever and release tabs pivot so that a locking mechanism can be manipulated. All of the parts used with the apparatus are inexpensive plastic parts that can be injection molded, and the apparatus can be quickly assembled by snapping parts together.

14 Claims, 5 Drawing Sheets

COLLAPSIBLE GARMENT HANGER WITH QUICK-RELEASE LEVER

CROSS-REFERENCE TO RELATED APPLICATION

This application is a continuation-in-part of application Ser. No. 10/985,556, filed Nov. 10, 2004.

BACKGROUND OF THE INVENTION

The majority of residences in the developed world have at least one closet full of articles of clothing on garment hangers. Using garment hangers for clothing storage provides easier viewing and access to clothing, and it is usually faster to hang clothing as opposed to folding. There are numerous different styles of garment hangers that meet budget constraints and clothing needs. People tend to invest more money on a garment hanger used with an expensive suit or jacket, but not for a shirt or sweater. Dress shirts, T-shirts, pull-overs and turtle necks frequently are placed on an inexpensive plastic or metal hanger. A problem that is often just tolerated is that the neck openings of these garments must be stretched or unbuttoned if the garment is removed from the hanger while it is still on a clothes rod. A closely related problem occurs when these garments are removed from the hanger by simply tugging on a shoulder of the garment until it stretches the neck opening over a hanger arm. The resulting spring force, when the garment is released from the hanger, commonly causes the hanger to be propelled off the clothes rod. Granted, all of these problems could be avoided if a person were to unhook the hanger and remove the garment by feeding the hanger down through the bottom of the garment, but this is awkward for most, and time consuming if the hanger snags on the inside of the garment while being removed.

Many have tried to develop a cost effective foldable or collapsible hanger that is easy to operate and will accommodate narrow-necked shirts and sweaters. Most of the prior art of the last 120 years is a variation of one or more of the following: the hanger arms are spring loaded and can temporarily be forced downwardly into a collapsed position, such as those described in U.S. Pat. Nos. 4,730,757, 4,813,581, 6,427,882, and 6,540,121; the hanger arms are spring loaded and can temporarily be forced laterally into a folded position, such as those described in U.S. Pat. Nos. 4,114,786, 4,988,021, and 5,480,076; or the hanger arms are normally in a locked position but can be released into a collapsed position, such as those described in U.S. Pat. Nos. 320,230, 395,884, 765,331, 2,509,754, 2,906,442, 2,941,704, 4,186,857, 4,231,499, 5,044,534, and 5,590,823. The first two variations are spring loaded devices, which can make them difficult to handle and control, so they present their own set of problems when a user attempts to insert and manipulate such a spring loaded garment hanger into the neck opening of a shirt. On the other hand, the garment hangers of the third variation frequently have many piece parts, are awkward to handle, or they are just too expensive to make available to the general public.

SUMMARY OF THE INVENTION

The present invention is an apparel apparatus, and more specifically a garment hanger that has arms that drop when a quick-release lever is squeezed. The preferred embodiment only requires three piece parts formed from just two injection molds, thereby creating a cost-competitive collapsible hanger that is easy to manufacture, assemble and use. An alternate preferred embodiment has a quick-release lever arm that latches around the hanger's neck such that the quick-release lever arm may be flipped to the side to cause the hanger arms to drop, with one of the hanger arms remaining in a substantially fixed position relative to the hook of the garment hanger. In addition to low cost and easy use, a major focus of the present invention is extremely rapid removal of a garment from a hanger without damaging or stretching the garment. There isn't a return force that brings the hanger arms back to a locked position, so some of the clumsiness seen in the prior art devices has been eliminated. Also, the overall appearance of the collapsible hanger of the present invention is very familiar, and operation of the device is immediately obvious and natural for most.

The most preferred embodiment of the present invention requires a hanger body and two hanger arms that are interchangeable. The parts are injection molded plastic and can be snapped together in a few seconds. The hanger body has a base and a cover that are separated by a fulcrum, the separation defining a cavity. The hanger arms can rotate within the bottom section of the cavity, and the top section of the cavity is used to manipulate the cover so the hanger arms can be locked into position within the bottom of the cavity, or they can be released and allowed to fall into a collapsed position. There are several alternate embodiments that function the same way, with a release lever on the top of the cover that is squeezed to drop the hanger arms, but the piece parts and method of assembly are different.

In the alternate preferred embodiment of the present invention, the hanger body is molded to one of the hanger arms, and the other hanger arm is molded to a quick-release lever arm. The hanger arms are pivotally secured to each other by a rivet that additionally functions to provide resistance against the quick-release lever arm such that the quick-release lever arm is normally being pressed against the neck of the hanger, thereby causing the quick-release lever arm to latch around the neck of the hanger assembly. A further feature of the alternate preferred embodiment is that it may be rotated into an extended position so that it can uniquely and alternately be slipped through the sleeve of a shirt, or it may be rotated into a fully collapsed position having a very compact size that may be easily packed in luggage when traveling.

Figure 1:
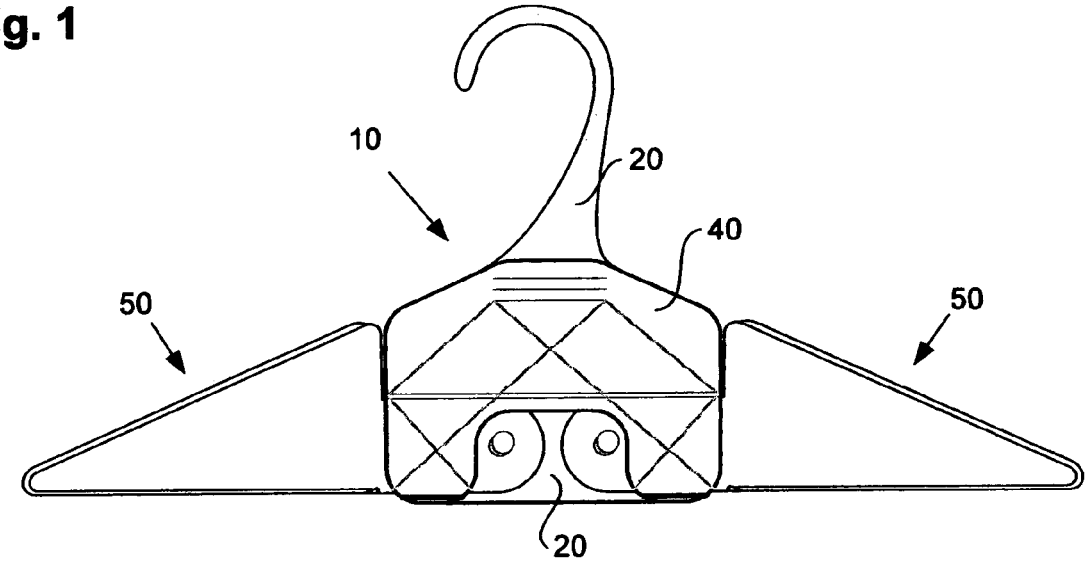
FIG. 1 is a perspective view of a collapsible hanger of the present invention—in the locked position.

The following is the list of numerical callouts used in FIGS. 1-4:

10 hanger body
20 base
22 hook
24 hanger neck
26 back
28 aperture
30 cavity
32 fulcrum
40 cover
42 quick-release lever
44 flange
46 release tab
48 teeth
50 hanger arm
52 broadened garment support
54 hanger shoulder
56 pin
58 distal tip
60 lateral reinforcement structure The following is the list of numerical callouts used in FIGS. 9-21:

62 hook
64 neck
66 slope
68 chamfer
70 right hanger arm
72 right hanger shoulder
74 right aperture
76 right distal tip
78 right hollow
80 left hanger arm
82 left hanger shoulder
84 left aperture
86 left distal tip
88 left hollow
90 rivet
92 quick-release lever arm
94 notch
96 elevated bevel
98 strap pegs

DETAILED DESCRIPTION OF THE INVENTION

The most preferred embodiment of the present invention, shown in FIGS. 1 through 8, requires a hanger body 10 and two hanger arms 50. Because the two hanger arms are interchangeable, only two plastic piece parts need to be manufactured, preferably using an injection molding process. Assembly is easily accomplished by snapping two hanger arms into one hanger body. This specification will describe from the top to the bottom, as defined by FIG. 1, the preferred embodiment's hanger body and hanger arms, followed by assembly and function, and then alternate embodiments will be described. Preferred materials, shapes, methods of attachment and methods of assembly will be discussed, but these preferences are not intended to exclude suitable or functionally equivalent alternatives.

Figure 3:
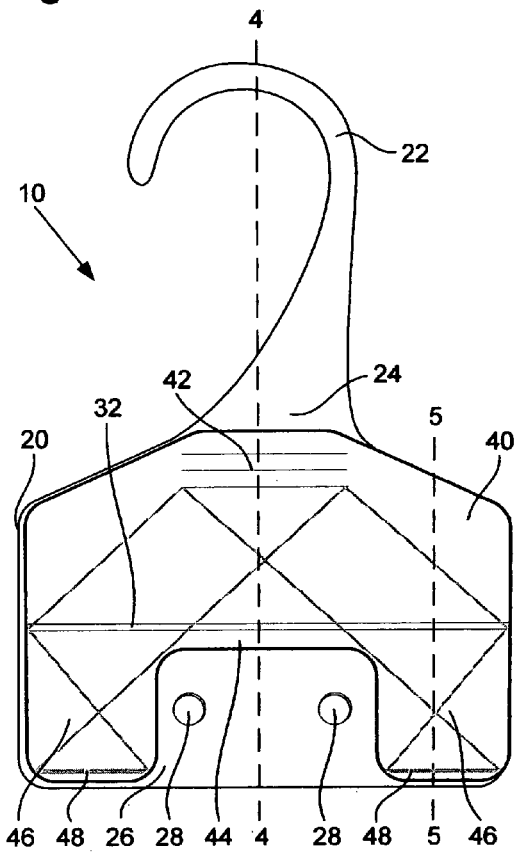
FIG. 3 is an enlarged perspective view of the hanger body used with the collapsible hanger of FIG. 1.
Figure 4:
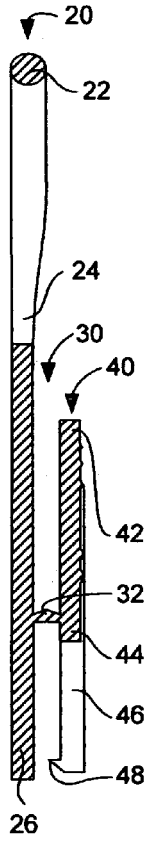
FIG. 4 is a cross section through line 4-4 of the hanger body of FIG. 3.
Figure 5:
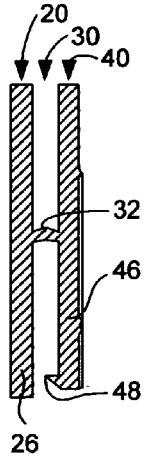
FIG. 5 is a cross section through line 5-5 of the hanger body of FIG. 3.

The hanger body 10 is comprised of three thicknesses: a base 20, a cavity 30 and a cover 40 (best seen in FIGS. 3-5). The base, from the top down, includes a hook 22, a hanger neck 24, a back 26 and apertures 28. The cavity includes a fulcrum 32 that holds the base in spaced relation to the cover such that a substantially uniform separation is normally maintained. The cover includes a quick-release lever 42, a flange 44, and release tabs 46 that have teeth 48 that project into the very bottom of the cavity. The least expensive and most preferred hanger body is molded from a strong and elastic material, preferably a thermoplastic or thermosetting polymer of high molecular weight, such as nylon.

As seen in FIG. 3, the base 20 of the hanger body 10 incorporates, at its top, a hook 22 that is similar in shape and size to the hooks on conventional clothing hangers designed to be supported by a pole or a rod. The thickness of the material at the hook will depend on the strength of plastic used to make the hanger body, but a common solid tubular nylon construction should have roughly a ten millimeter diameter, with the circular design of the hook having about a fifty millimeter diameter. Starting at about the base of the hook, the hanger neck 24 should broaden and flatten as it gets farther from the hook until it gradually meets a large flat structure that is the back 26 of the base. About three-quarters of the way down the back, there are two apertures 28 that are fairly symmetrically located on opposite sides of the vertical centerline 4-4 of the collapsible hanger (see FIG. 3). It should be noted that the vertical centerline passes through the center of the hook design's diameter.

As seen in FIGS. 4 and 5, the cavity 30 of the hanger body 10 lies just adjacent the back 26 of the hanger body. The cavity has a top section and a bottom section which are divided by a fulcrum 32. The fulcrum is most preferably molded as part of the base 20 and cover 40 such that it protrudes into the cavity from about the horizontal centerline of the back. The fulcrum is strong, elastic, and will recover its original shape after an applied squeezing force is released. Because the fulcrum will frequently be distorted, it may be necessary to include accordion-like bends or stress relief structures along the fulcrum's length to avoid premature failure. The fulcrum also determines the thickness of the cavity because the fulcrum acts to substantially hold the cover in a uniformly spaced relation to the base such that the base and cover normally lie in nearly parallel planes.

The cover 40 is similar to the base 20 in overall size, thickness, and flatness. The cover, like the cavity 30, is similarly divided by the fulcrum 32 into a top section and a bottom section. The top section of the cover, which is by function the quick-release lever 42, lies over the top section of the cavity. The bottom section of the cover, which lies over the bottom section of the cavity, has two release tabs 46 separated by a central flange 44 that is adjacent the fulcrum. The flange is for guiding the hanger arms 50 into the apertures 28 during assembly and use. Just below the flange is an open area in the bottom section of the cover that exposes the apertures in the back 26 of the hanger body. The release tabs, which are on the opposite side of the fulcrum as the quick-release lever, include teeth 48. The teeth point into the cavity and are beveled such that objects may easily enter the cavity, but not exit. Although there is only a single row of teeth shown in the various figures, one or more additional rows of teeth may be added adjacent the first row, along with corresponding ridges that should be molded into the hanger shoulder 54 of the arms so that the multiple rows of teeth can function together to hold the hangers arms in a locked position.

Figure 6:
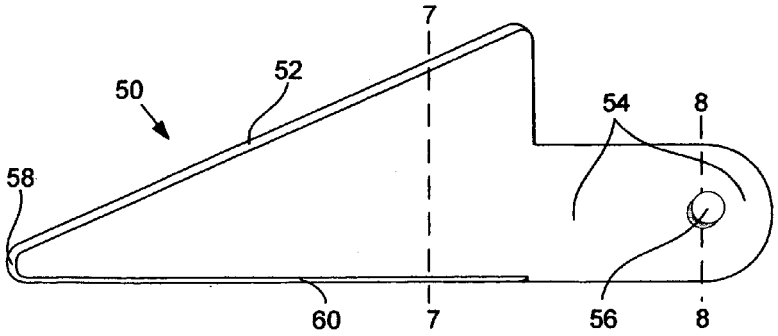
FIG. 6 is an enlarged perspective view of a hanger arm used with the collapsible hanger of FIG. 1.
Figure 7:
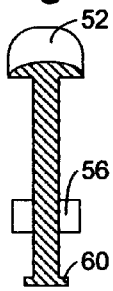
FIG. 7 is a cross section through line 7-7 of the hanger arm of FIG. 6.
Figure 8:
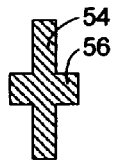
FIG. 8 is a cross section through line 8-8 of the hanger arm of FIG. 6.

As seen in FIGS. 6 through 8, the hanger arms 50, which are symmetrical and interchangeable, are the other molded part of the collapsible hanger of the present invention. The hanger arms are most preferably made from the same plastic as the hanger body 10. The top of a hanger arm is crested with a broadened garment support 52. A hanger arm has a hanger shoulder 54 that, at its center point, includes a pin 56 that extends outwardly from both major surfaces of the hanger shoulder. The hanger shoulder is rounded and smoothed to minimize friction, except along the bottom edge of the hanger shoulder. Farthest from the hanger shoulder is the distal tip 58. A lateral reinforcement structure 60 has been included on the bottom of the hanger arm, except under the hanger shoulder, to prevent it from bending under the weight of a heavy garment.

Figure 2:
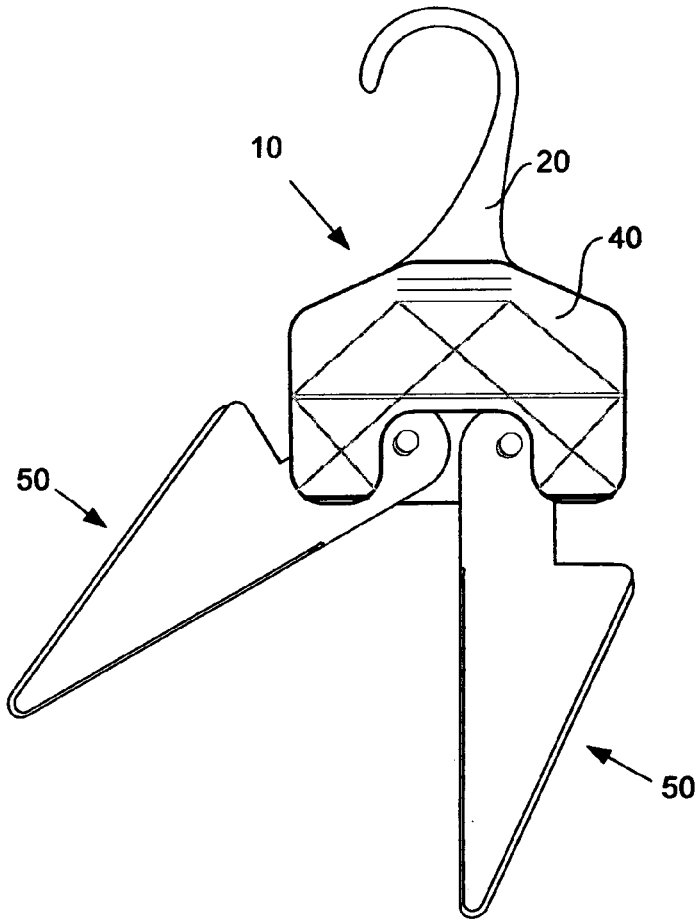
FIG. 2 is a perspective view of the collapsible hanger of FIG. 1 after the hanger arms have been released—in a collapsed position.

Assembly of a hanger is quickly accomplished by forcing the hanger shoulders 54 of two hanger arms 50, distal tips 58 pointing down, and the flange 44 of a hanger body 10 until the pins 56 snap into the apertures 28 such that each pin is rotateably joined with an aperture. The orientation only requires that the two hanger arm's lateral reinforcement structures 60 are adjacent each other, which places a just assembled hanger in the fully collapsed position. FIG. 2 shows the left hanger arm in a partially collapsed position, and the right hanger arm in the fully collapsed position. To bring the hanger arms into a locked position, which is the position a hanger must be in to support a garment, the distal tips are separated until each hanger shoulder has been rotationally moved into the bottom section of the cavity 30, under each of the release tabs 46. The teeth 48 will allow the hanger arms to move freely until the bottom edges of the hanger shoulders are independently gripped by the teeth into the locked position, which is the position shown in FIG. 1.

To operate an assembled collapsible hanger of the present invention, a user provide squeezing force is applied against the hanger neck 24 of the base 20 and the top of the quick-release lever 42. The applied force will temporarily distort the hanger body 10 at the fulcrum 32 and allow the quick-release lever to pivot about the fulcrum and travel through the top section of the cavity 30 toward the hanger neck. The base and cover 40 will substantially maintain their shape, but the fulcrum bends, so the release tabs 46 and quick-release lever work and move like the two ends of a seesaw. The relatively insignificant travel of the areas of the release tabs nearest the fulcrum, as well as the very limited travel of the flange 44, prevents the pins 56 from coming out of their apertures 28. The teeth 48, which are far away from the fulcrum, experience a significant amount of travel away from the back 26. The flange works to hold the hanger shoulders 54 against the base so that the rotationally joined pins and apertures do not separate. Conversely, the teeth pivot away from the hanger shoulder and back of the base until the hanger arms disengage from the locked position and drop under the force of gravity into the collapsed position. A shirt that was being held by the broadened garment supports 52 of the hanger arms 50 will fall off the collapsible hanger because the neck opening of the shirt will be much larger than the collapsed hanger by the time the distal tips 58 are adjacent each other. The hanger arms must be manually returned to the locked position.

There are numerous deviations from the above described preferred embodiment that are predominantly aesthetic, but nonetheless require minor changes in functional aspects. A first alternate embodiment is design to give the collapsible hanger of the present invention a sleeker, more aesthetic look that uses less material, but at the cost of some strength and stability. By compacting the hanger body, the hanger arms can be designed to look long and sleek, preferably with broadened garment supports that eliminate the need for the lateral reinforcement structures, which will give the hanger body with hanger arms an overall umbrella shape. A more compact hanger body will also allow the quick-release lever to be moved up, at least partially into the hanger neck, so the fulcrum can be positioned much closer to the hanger neck.

A second alternate embodiment uses a two piece hanger body that includes snap-fit fasteners, such as mushroom pins, that function to hold the cover piece to the base piece. The mushroom pins may be molded right into either the cover piece or the base piece, and the mushroom pins additionally serve the same purpose as the pins that were on the hanger shoulders of the preferred embodiment. In place of pins, the hanger shoulders have shoulder apertures through which the mushroom pins pass during assembly so the hanger arms are rotateably joined to and sandwiched between the cover piece and base piece. During operation, the top most edge of the hanger shoulder functions as the fulcrum about which the cover piece pivots, so there is no need to mold a fulcrum into the cover piece or base piece.

A third alternate embodiment, which is very similar to the preferred embodiment, has only one of the hanger arms rotateably joined to the hanger body, with the other hanger arm being permanently fixed or molded into the hanger body. Because the fulcrum serves just the one rotateably joined hanger arm, the fulcrum can be angled more towards being perpendicular to the required travel of the quick-release lever and release tab, which will put less stress on the fulcrum during operation of the collapsible hanger.

The alternate preferred embodiment, shown in FIGS. 9-19, has been designed such that the functional aspects of the hanger body have been integrated into hanger pieces that include the hanger arms. The alternate preferred embodiment's assembly requires a right hanger piece and a left hanger piece that are joined by a fastener, such as a rivet. The manufacturing cost of the alternate preferred embodiment has been significantly reduced by eliminating the need for any slides in the tooling and by reducing the overall weight of the collapsible hanger. Using polypropylene and the dimensions described herein, the weight of an alternate preferred embodiment should be approximately sixty grams.

Figure 9:
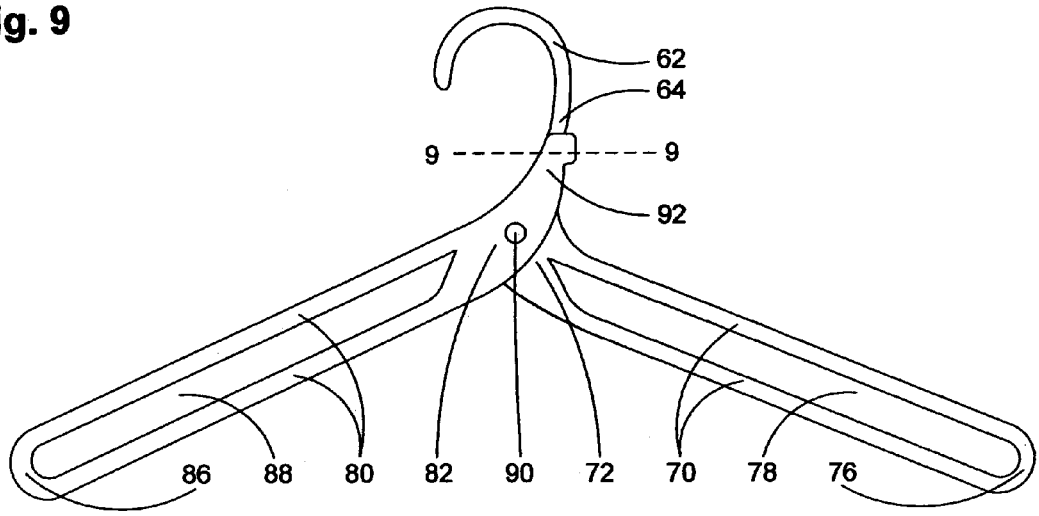
FIG. 9 is a perspective view of the alternate preferred embodiment of the collapsible hanger of the present invention—in the locked position.
Figure 10:
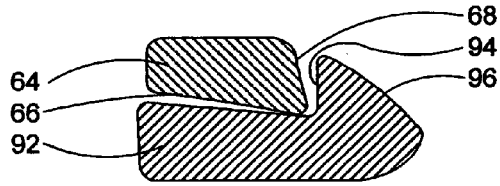
FIG. 10 is an exploded cross sectional view, through line 9-9, of the clasp design used with the hanger of FIG. 9.
Figure 11:
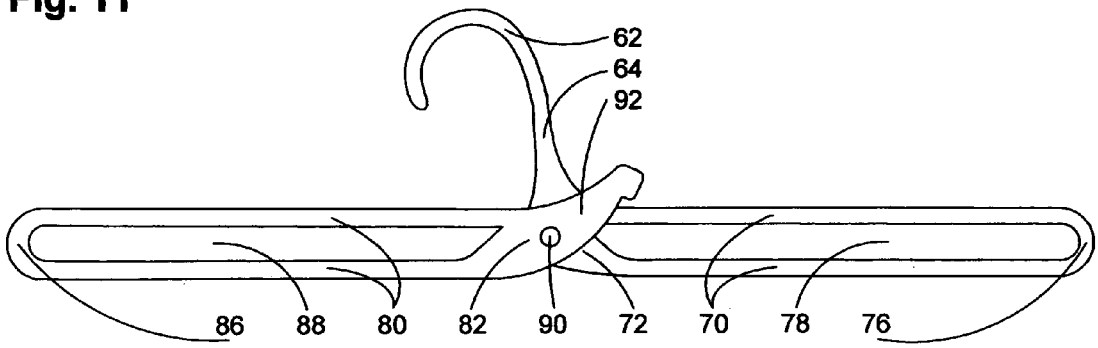
FIG. 11 is a perspective view of the hanger of FIG. 9 in the extended position.

FIG. 9 shows the alternate preferred embodiment in the locked position, which is suitable for supporting a garment, and we will define the right and left sides based on the view in FIG. 9. The right hanger piece, which is independently shown in FIGS. 18 and 19, includes a large hook 62 that is used to support the hanger over the top of a clothes rod in the traditional way. The hook in FIG. 9 is substantially a 10 mm rod that bends around a curve. One end of the hook, opposite the free end, extends downwardly into the hanger's neck 64, right hanger shoulder 72, right hanger arm 70, and then all the way out to the right distal tip 76. FIG. 9 shows the free end of the hook facing away from the right distal tip so the hanger can more easily be placed on a clothes rod. Other than at the hook, the right hanger piece is about 5 mm thick. The right hanger shoulder includes a centrally located right aperture 74. The long middle section of the right hanger arm has been lightened such that there are two 8 mm wide bars separated by a roughly 15 mm wide right hollow 78. The distance from the right aperture to the right distal tip is about 250 mm for a typical adult-sized hanger.

Figure 16:
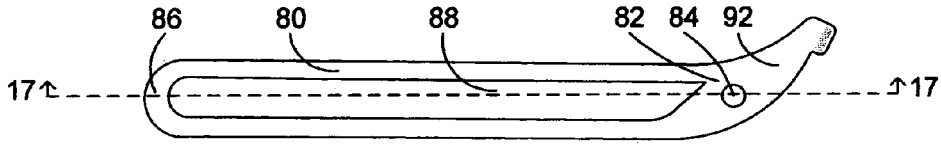
FIG. 16 is a perspective view of the left hanger arm used in FIG. 9, which includes the quick-release lever arm and clasp.
Figure 17:
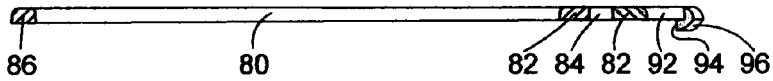
FIG. 17 is a cross sectional view, through line 17-17 in FIG. 16, of the arm design used with the hanger of FIG. 9.
Figure 18:
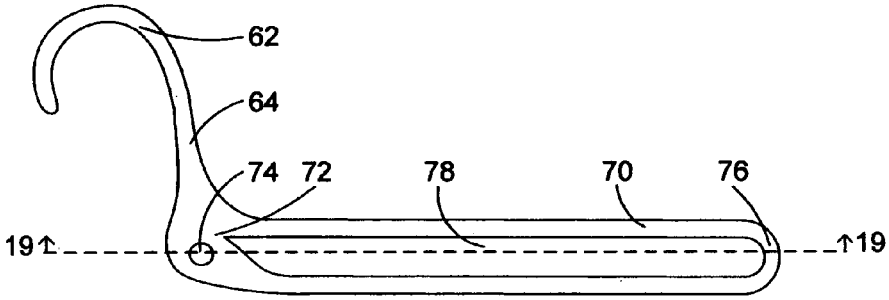
FIG. 18 is a perspective view of the right hanger arm of FIG. 9, which includes the hook and neck.
Figure 19:
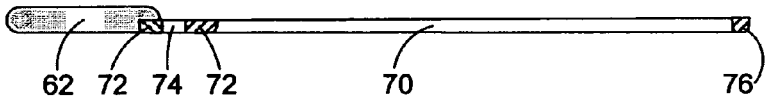
FIG. 19 is a cross sectional view, through line 19-19 in FIG. 18, of the clasp design used with the hanger of FIG. 9.

The left hanger piece, which is independently shown in FIGS. 16 and 17, includes a quick-release lever arm 92 that extends downwardly into the left hanger shoulder 82, left hanger arm 80, and then all the way out to the left distal tip 86. The left hanger piece also includes a left aperture 84 and a left hollow 88. Measurements and construction of the left hanger shoulder, arm and distal tip are substantially identical to the same features on the right hanger piece. FIG. 9 shows the left hanger shoulder being in front of the right hanger shoulder, but this arrangement is just a matter of preference that seems to favor right handed people.

Figure 12:
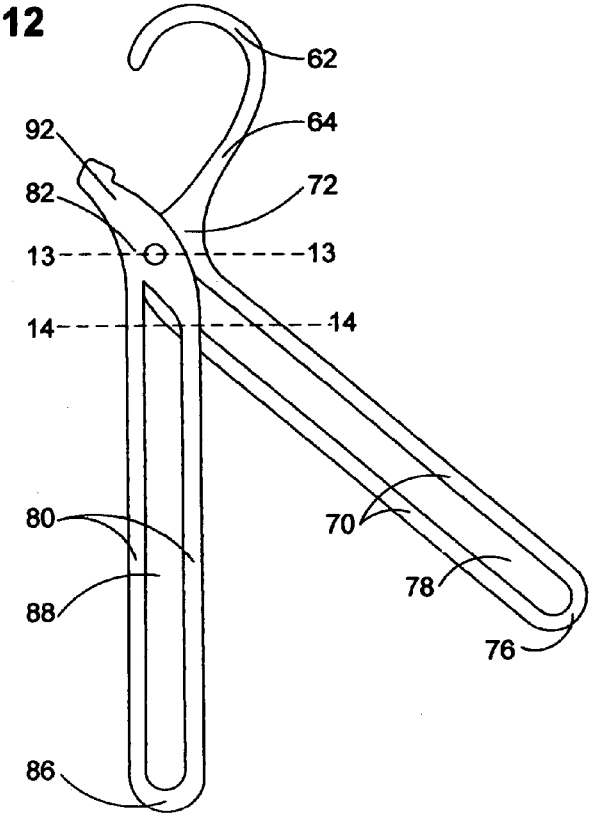
FIG. 12 is a perspective view of the hanger of FIG. 9 in a collapsed position.
Figure 13:
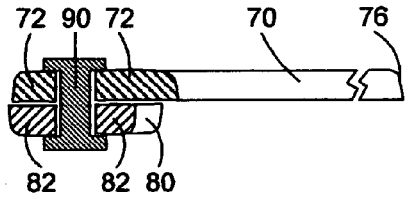
FIG. 13 is an exploded cross sectional view, through line 13-13 in FIG. 12, of the rivet and hinge design used with the hanger of FIG. 9.
Figure 14:
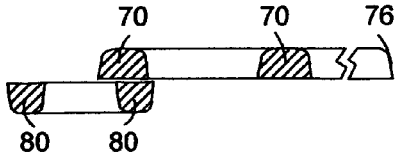
FIG. 14 is an exploded cross sectional view, through line 14-14 in FIG. 12, of the arm design used with the hanger of FIG. 9.
Figure 15:
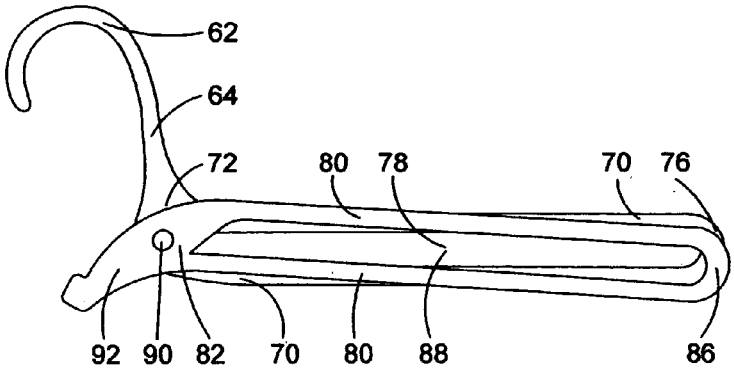
FIG. 15 is a perspective view of the hanger of FIG. 9 in the storage position.

A rivet 90 passes through the right aperture 74 and the left aperture 84 to fasten the right hanger shoulder 72 against the left hanger shoulder 82 such that the hanger arms 70 and 80 may be rotated into different relative positions. The relative positions are most easily described using the angle defined by the left distal tip 86, the rivet 90, and the right distal tip 76. In the locked position, shown in FIG. 9, this angle is approximately 130 degrees. In the extended position, shown in FIG. 11, the distal tips have been rotated to a substantially maximal separation which makes this angle approximately 180 degrees. In collapsed positions, this angle is greater than approximately zero degrees and less than the number of degrees defined by the locked position, but it is shown in FIG. 12 as being approximately 50 degrees. In the storage position, shown in FIG. 15, the distal tips are substantially adjacent each other such that this angle is approximately zero degrees.

When the hanger is manipulated from the storage position to increasingly obtuse collapsed positions, an elevated bevel 96 that is on the quick-release lever arm 92 of the left hanger piece eventually meets the hanger neck 64. A slight resistance is felt with continued rotation of the hanger arms because the elevated bevel forces the quick-release lever arm away from the hanger neck while the rivet 90 tries to keep the left and right hanger shoulders in parallel planes. An optional slope 66, most clearly seen in FIG. 10, has been added to the hanger in FIG. 9 to soften the slight resistance. At approximately 130 degrees of rotation, the elevated bevel passes the hanger neck and the hanger shoulders abruptly return to parallel planes, except that a notch 94 at the peak of the elevated bevel blocks the hanger arms from returning to a collapsed position. This locked position is suitable for holding the hanger arms in an orientation that will support garments, such as shirts and sweaters. The holding ability of the locked position may be enhanced by adding a chamfer 68 to the hanger neck.

The hanger may be easily manipulated from the locked position to an even greater angle, up to 180 degrees or more, before the elevated bevel again meets resistance by hitting the right hanger arm. This extended position is useful for sliding the hanger assembly through a garment neck until the hanger is partially down one of the garment arms. The streamlined shape of the extended position allows the hanger to easily pass through even the narrowest of garment necks without stretching the garment. Once both distal tips have passed through the garment's neck, the hook is pulled back out through the garment's neck while the distal tips are allowed to fall under the force of gravity until the hanger assumes the locked position. The garment may now be hung in a closet by catching the hook over a clothes rod. To remove the garment from the hanger, the elevated bevel is simply flipped away from the hanger neck by a user's thumb or finger, thereby causing the distal tips to drop. The garment will then slip off the hanger and the hanger will come to rest in a collapsed position without ever having been removed from the clothes rod.

The light weight design and compactness of a hanger in the storage position allows the hanger to be easily packed with luggage while traveling. An additional advantage of the storage position is the ability to compactly package hangers that are being sold. Much of the bulk and expense associated with storing an inventory of hangers may be significantly reduced, not to mention the lower shipping costs that may be achieved by taking advantage of the compactness of the storage position. An additional use of the compactness of the storage position is the option of feeding the adjacent distal tips into a garment's neck and then rotating the hanger arms into the locked position, which is another quick method of hanging a garment without stretching the garment's neck.

Figure 20:
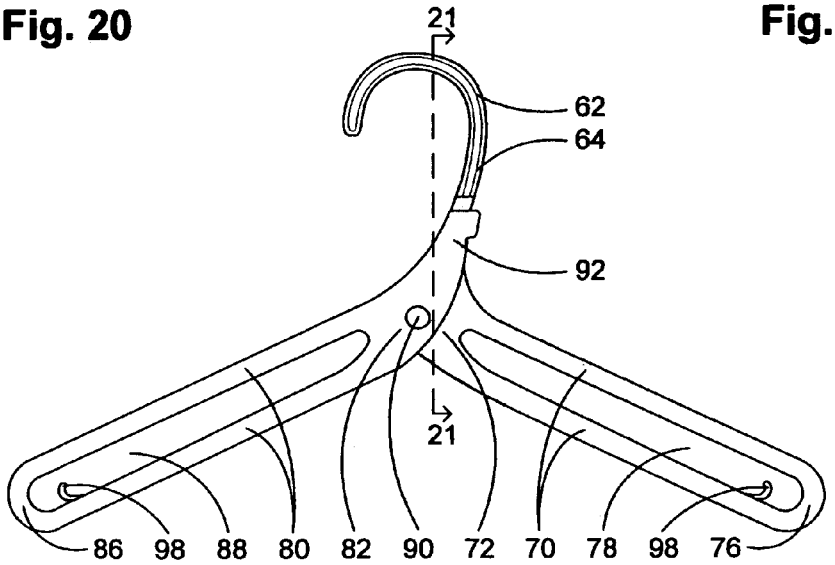
FIG. 20 is a perspective view of an alternate embodiment that is very similar to the hanger of FIG. 9, except that the hanger arms have been shortened so they are better suited for use with children's clothing.
Figure 21:
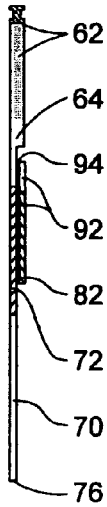
FIG. 21 is a cross sectional view, through line 21-21, of the collapsible hanger shown in FIG. 20.

FIGS. 20 and 21 show a modified alternate preferred embodiment that is very similar to the collapsible hanger of FIG. 9, but the distance from an aperture to a distal tip has been shortened to about 170 mm so that the hanger is better suited for use with children's clothing. Also, two new features have been added, strap pegs 98 and a reinforced hook structure, and these features may optionally be incorporated into the hanger of FIG. 9. The strap pegs serve the same function as strap hooks that are seen on many common hangers, but the strap pegs are much stronger because the weight bearing surface includes the hanger arms themselves. The strap pegs are about 2 mm thick and they are placed inside the hollows so they will not catch on a garment that is being removed from the hanger. Strapped garments that are properly supported by the strap pegs will drop off the hanger when the hanger is released into a collapsed position. The other modified feature is a reinforced hook that uses a simple "H" structure, thereby allowing for a slight reduction in material.

Another feature that may be optionally included with the alternate preferred embodiment is a lip, or other protruding structure, placed along the top of at least one of the hanger arms. The lip should prevent the hanger arms from excessive rotation beyond the storage position, such as to a position having an angle of 340 degrees, by blocking the underside of the opposing arm in much the same way that the notch on the elevated bevel blocks the hanger arms from returning to a collapsed position. The preferred location of the lip is approximately at the border between the left hanger arm and the left hanger shoulder, and the lip need only be about 10 mm or less long and have an elevation that is a couple of millimeters high.

While a preferred form of the invention has been shown and described, it will be realized that alterations and modifications may be made thereto without departing from the scope of the following claims. For example: adding very broad distal tips that somewhat resemble upside-down spoons; including a non-slip cover or coating on the hanger arms; adding garment strap hooks or pegs to the hanger arms; supporting the hanger shoulders under the broadened garment supports rather than under the bottom edge of the hanger shoulders; or adding a swivel attachment to the hanger neck can be designed into the disclosed embodiments of the present invention by one skilled in the art. Also, it is advisable that unforgiving edges and comers be smoothed or shaped into a nearby structure to prevent a garment from getting caught or damaged unnecessarily.

What is claimed is:

1. A collapsible garment hanger comprising:

a right hanger piece having a hook, a hanger neck, a right hanger shoulder, a right hanger arm and a right distal tip;

a left hanger piece having a quick-release lever arm, a left hanger shoulder, a left hanger arm and a left distal tip;

a fastener that rotationally joins the right hanger shoulder against the left hanger shoulder such that one of the shoulders is at least partially in front of the other shoulder;

a locked position, characterized by the quick-release lever arm being at least partially latched around the hanger neck;

at least one collapsed position, characterized by the right distal tip being in closer proximity to the left distal tip as compared to the locked position;

an extended position, characterized by the right distal tip and left distal tip having been rotated away from the locked position about the fastener to a substantially maximal separation; and wherein the quick-release lever may be unlatched by a user, without the use of tools, such that the hanger arms may rotate from the locked position to the at least one collapsed position.

2. The collapsible garment hanger of claim 1 wherein the left hanger shoulder and the right hanger shoulder are each characterized by an aperture; and wherein the fastener passes through each of the apertures to rotationally join the right hanger shoulder against the left hanger shoulder.

3. The collapsible garment hanger of claim 1 wherein one of the left hanger shoulder or the right hanger shoulder is characterized by a protruding pin and the other hanger shoulder is characterize by an aperture tat receives the pin, and wherein the pin is expanded or otherwise secured against the other hanger shoulder to function as the fastener.

4. The collapsible garment hanger of claim 1 wherein a free end of the hook is facing away from the right distal tip.

5. The collapsible garment hanger of claim 1 wherein a free end of the hook is facing toward the right distal tip.

6. The collapsible garment hanger of claim 1 wherein the right hanger shoulder is fastened in front of the left hanger shoulder.

7. The collapsible garment hanger of claim 1 wherein the left hanger shoulder is fastened in front of the right hanger shoulder.

8. The collapsible garment hanger of claim 1 further comprising hollows in the hanger arms.

9. The collapsible garment hanger of claim 8 further comprising strap pegs that lie inside the hollows of the hanger arms.

10. The collapsible garment hanger of claim 1 wherein the quick-release lever arm is characterized by an elevated bevel that, at its peak, includes a notch that functions to latch the quick-release lever arm to the hanger neck when the collapsible garment hanger is in the locked position.

11. The collapsible garment hanger of claim 10 wherein the hanger neck is characterized by a chamfer that engages the notch at an angle when the collapsible garment hanger is in the locked position.

12. The collapsible garment hanger of claim 10 wherein the hanger neck is characterized by a slope that gradually engages the elevated bevel as the collapsible garment hanger is rotated from a collapsed position to the locked position.

13. The collapsible garment hanger of claim 1 further comprising a lip placed along the top of at least one of the hanger arms.

14. The collapsible garment hanger of claim 1 further comprising broadened garment supports that extend along a top part of each of the hanger arms such that there is a crested surface area over which a garment may hang.

* * * * *